United States Patent [19]

Neville

[11] Patent Number: 4,485,524

[45] Date of Patent: Dec. 4, 1984

[54] RECESSED HINGE WITH AN ADJUSTABLE PIVOT POINT

[76] Inventor: Donald G. Neville, 315 34th St., Manhattan Beach, Calif. 90266

[21] Appl. No.: 385,099

[22] Filed: Jun. 4, 1982

[51] Int. Cl.[3] ..... E05D 7/06

[52] U.S. Cl. ..... 16/241; 16/245; 16/342; 16/361; 16/382

[58] Field of Search ..... 16/337, 342, 345, 347, 16/348, 352, 358, 360, 361, 366, 371, 382, DIG. 17, 240, 241, 245, 331, 357; 220/331

[56] References Cited

U.S. PATENT DOCUMENTS

| | | | |
|---|---|---|---|
| 1,075,130 | 7/1913 | Streberger | 16/358 |
| 1,200,477 | 10/1916 | Frantz | 16/348 |
| 3,196,480 | 7/1965 | Whittom | 16/339 |
| 3,231,927 | 2/1966 | Ammon | 16/331 |

FOREIGN PATENT DOCUMENTS

| | | | |
|---|---|---|---|
| 842662 | 6/1939 | France | 16/358 |
| 56-01900 | 12/1980 | Japan | 16/352 |
| 795864 | 6/1958 | United Kingdom | 16/358 |

*Primary Examiner*—Fred Andrew Silverberg

*Attorney, Agent, or Firm*—Romney Golant Martin & Ashen

[57] ABSTRACT

A glass cover for an enclosure is mounted over an opening in the enclosure by a pair of recessed hinges, each of which includes a hinged body. There are two slots in each hinged body. Each hinged body is positioned within a recess in the enclosure wall. The hinge also includes a frictional member positioned in one of the slots in the hinged body, and a cover holder. Two pins couple the cover holder to the hinge body. One of the pins is coupled to the friction member; this pin passes through one of the slots into a socket in the friction member. The other pin is positioned within the other slot. The frictional member engages a portion of the hinged body defining the perimeter of the slot in which it is disposed. As the cover is raised and lowered, the frictional member rides along this slot. The frictional forces between the side walls of the slot and the friction member are such that the cover remains stationary when the person lifting the cover releases his or her grip. A cover-leveling system is also provided, and the shape of the hinge body is designed for easy installation.

25 Claims, 21 Drawing Figures

RECESSED HINGE WITH AN ADJUSTABLE PIVOT POINT

BACKGROUND OF THE INVENTION

1. Field of The Invention

This invention relates to hinges, and specifically to a recessed hinge which has a variable pivot point and includes a friction member for holding the hinge, and attached enclosure cover, in an open position when the cover is raised.

2. Background Discussion

Expensive cabinets and like enclosures presently employ spring biased hinges for mounting the covers to the enclosures. The covers are typically tempered plate glass and the hinges have a mouth for receiving the edges of the glass cover. When the cover is placed in the hinge mouth, a pressure plate is inserted between the glass and the lip of the mouth and screws in the lip are tightened to push the pressure plate snug against the flat surface of the glass cover. The installation of the glass cover is carried out by the purchaser of the cabinet and, since this individual is ordinarily not expert in mounting the glass cover, frequently breakage occurs.

The hinges currently employed are bulky and are not recessed in the cabinet. Rather they are screwed into the exterior surfaces of the cabinet and detract from the streamlined features of the cabinet. Not only do the hinges detract from the appearance of the cabinet, the cabinet manufacturer often must employ heavy wood in order to properly mount the hinge. For example, the back of the cabinet uses a relatively thin sheet of wood panel, approximately $\frac{3}{8}$ inch thick, but at the point where the hinge is to be secured to the back, thick wood stock must be employed, for example $\frac{1}{2}$ inch thick wood. This increases the cost of the cabinet.

The hinges now employed are designed so that with the cover either partially or completely open, the cover will stay in the raised position. This is due to the action of a spring which counter balances the weight of the glass cover. Because the covers vary in weight, a relatively large number of different strength springs must be retained in inventory by the manufacturer of the cabinets, thus adding further to the cost of the cabinet.

SUMMARY OF THE INVENTION

Briefly, the hinge of this invention is adapted to be mounted within a recess in an enclosure wall and it comprises (a) a hinge body having first and second slots therein, (b) a friction member disposed within the first slot and in frictional engagement with a portion of the hinged body defining the perimeter of the first slot, (c) means for holding the cover, and (d) a pair of pin means coupling the cover holding means to the hinged body, one of the pin means being coupled to the frictional member and the other being disposed within the second slot.

The hinge body has three edges, one of the edges being arcuately shaped and the other two being generally straight. The edges abut each other at their ends such that one of the straight edges abuts one of the ends of the arcuately shaped edge and the other of said straight edges abuts the opposite end of the arcuately shaped edge. The two straight edges abut each other at their ends remote from the arcuately shaped edge to form an angle therebetween of approximately 90°. Preferably, the arcuately shaped edge encompases approximately a semi-circle. This shaped hinge body is designed to fit easily into the corner of the enclosure where two of the enclosure walls meet. The recess in one of the walls will have a depth about equal to the thickness of the hinge body and have two open sides of a length approximately equal to the straight edges of the hinge body and an arcuately shaped rim at opposed ends of the opened sides. One of the open sides will be in an exposed edge surface of the wall carrying the recess and the other open side is in the concealed edge surface of the wall carrying the recess and will be disposed along the corner. The hinge body is seated in the recess with one straight edge adjacent the open side of the recess which lies along the corner, and the other straight edge is adjacent the open side in the exposed edge surface and is approximately flush with said exposed edge surface. The arcuately shaped edge of the hinge body is adjacent the arcuate rim of the recess. The rim and the arcuately shaped edge of the hinge body conform to one another. Thus, the hinge body fits snugly within the recess. As will be described in greater detail below, the recess is easily carved into the wood surface using conventional drilling equipment.

The pins preferably extend outwardly from one surface of the cover holding means. This cover holding means includes a mouth which receives an edge of the cover and lips about this mouth. A wedge is inserted into the mouth of the cover holder between the cover and one of the lips. The wedge includes a shoulder which enables a wedge removable device, such as a screwdriver, to be pushed against the shoulder for forcing the wedge from the mouth. Since no screws or pressure plates are employed to secure the cover in the mouth, the likelihood of breaking the glass cover is substantially reduced. The wedge is preferably made of a resilient plastic material so that it is compressed upon being inserted into the mouth. Because of its resiliency, the wedge applies a holding force against the cover.

In accordance with another feature of this invention, leveling means for the cover are provided. The leveling means include a separate element having an eccentric therein and the hinge body is mounted so that it may be rotated within the recess prior to the hinge being secured within the recess. The hinge body includes an elongated slot and the eccentric element is disposed within the slot and engages the hinge body so that rotation of the leveling member causes the hinge body to rotate, bringing the cover to a level condition.

The two slots which carry the pins are disposed along lines which intersect each other. One of the slots has opposed elongated sides which are generally straight and parallel to each other. The other slot has a slot opening which expands into an enlarged, sunken track section which has the same general configuration as the slot opening but is larger than the slot opening. The sides of this track section are arcuate, as are the sides of the slot opening. The opposed sides of both the track section and slot opening are concave and convex with respect to each other. One of the pins passes through the slot opening and into a socket in the frictional member which is disposed within the sunken track section, being slightly deformed upon being inserted into the track section. When the cover is raised, the frictional member rides along this track section, with the frictional force between the sides of the track section and the friction member ensuring that the cover will remain in a raised position upon being released by the person opening the cover.

The frictional member is made of a resilient material and is deformed, as mentioned above, upon being inserted into the slot because the width of the member is slightly greater than the width of the track section. Thus, there is an internal bias which urges the friction member against the sides of the track section. Preferably, the friction member is in the form of a plurality of thin wall annuli which are joined together. One of these provides the socket into which the one pin fits snugly and the others bear against at least a portion of the hinge body defining the track section. The annuli which engage the hinge body have diameters which may be increased or decreased depending upon the weight of the glass cover. Since it is easy to increase or decrease these diameters and since these frictional members are substantially less costly to retain in inventory than springs, a significant cost-saving is achieved by using this type of friction member.

There are several advantages of the hinge of the present invention. This hinge is recessed, thereby improving the appearance of the cabinet. It is easy to install and, because it has less parts than conventional hinges, is substantially less costly than these hinges. The different diameter friction members, because they are low cost and less bulky than springs used in conventional hinges, can be retained in inventory for substantially less cost. The cover holder, employing the wedge, avoids or minimizes the likelihood of breakage of the glass cover. The leveling member provides an easy way to level the glass cover. These and other advantages will be apparent upon considering the DESCRIPTION OF THE PREFERRED EMBODMENT which follows.

DESCRIPTION OF THE PREFERRED EMBODIMENT

Figure 1:
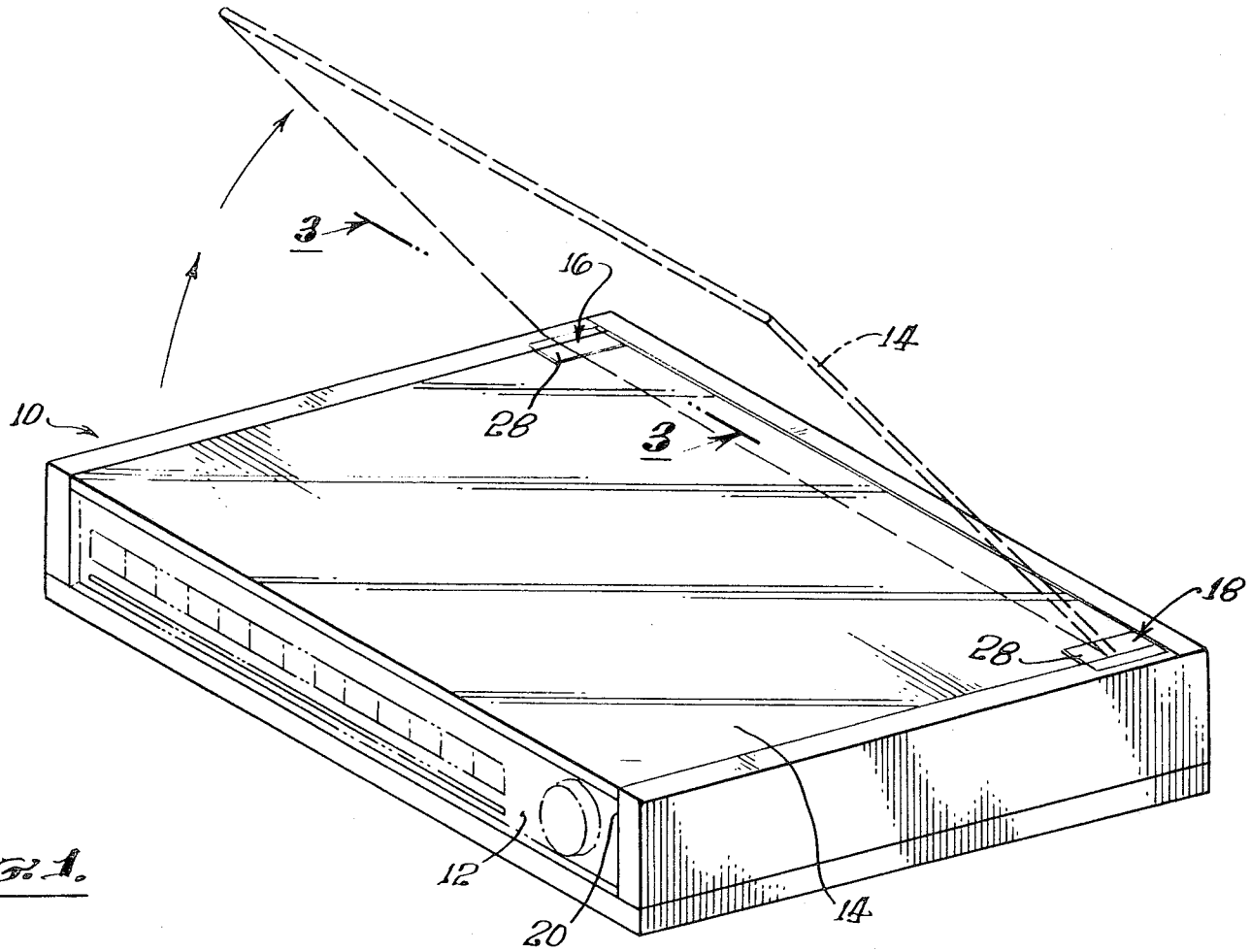
FIG. 1 is a perspective view of a cabinet having a glass cover mounted by the hinges of this invention.

While the present invention is susceptible to modifications and alternate constructions, an illustrative embodiment is shown in the drawings and will be described in detail here and below. It should be understood, however, that it is not the intention to limit the invention to the particular form disposed; but on the contrary, the invention is to cover all modifications, equivalences, and alternate constructions falling within the spirit and scope of the invention as expressed in the appended claims.

As shown in FIG. 1, an enclosure 10, such as a cabinet for a stereophonic equipment 12, has a plate glass cover 14 which is mounted to the enclosure by a pair of hinges 16 and 18 embodying the principles of this invention. The glass cover 14 is movable between a closed position (shown in solid lines), with the cover closing off an opening 20 in the enclosure, and an opened position (shown in dotted lines) with the cover raised to permit access to the stereophonic equipment 12. When in the raised or opened position, it will remain in this position because of the unique friction member 22 which is a vital component of the hinge of this invention. This friction member 22 shall be described in further detail below. The hinges 16 and 18 are essentially the same, except that they are right and left hand compliments. Only hinge 16, therefore, will be described in detail, with hinge 18 being given the same part numbers as hinge 16.

Figure 2:
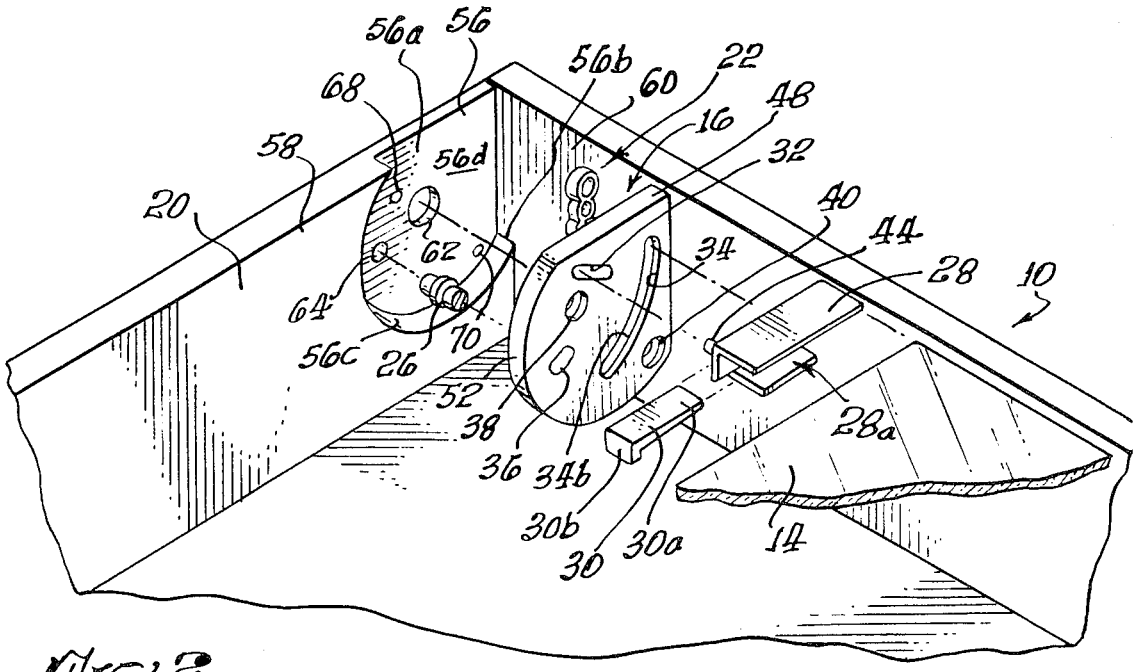
FIG. 2 is an exploded perspective view showing the hinge of this invention.

As best illustrated in FIG. 2, the hinge 16 has five components: (1) a hinge body 24, (2) the friction member 22, (3) a leveling member 26, (4) a cover holder 28, and (5) a wedge 30. The hinge body 24 preferably is made of a rigid plastic and has three slots therein 32, 34, and 36, a pair of spaced-apart screw openings 38 and 40, and a cylinderical pivot member 42 (FIG. 3) integral with the back of the hinge body. The friction member 22 is disposed within the one slot 34, in particular a sunken track section 34*a* of the slot. The cover holder 28 receives an edge portion of the glass cover 14 in its mouth 28*a* and a pair of pins 44 and 46 extend from the cover holder, with the one pin 46 passing into the slot 34 and engaging the friction member 22 and the other pin 44 being disposed in the slot 32. As the cover 14 is moved between the closed and open positions, the one pin 46 pulls the friction member 22 along the slot 34 and the other pin 44 rides along the slot 32. The wedge 30 has a tapered body terminating in a head end 30*a* and at its opposed end a shoulder 30*b* which is integral with the body. This shoulder 30*b* extends outwardly from the body at approximately a right angle with respect to the back portion of the body.

Figure 4A:
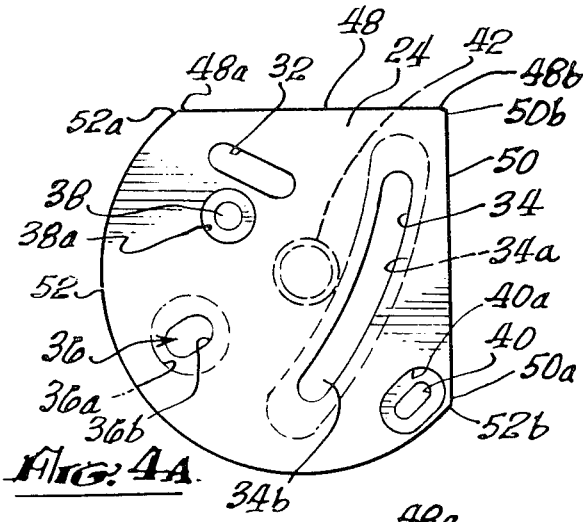
FIG. 4*a* is a cross-sectional view taken along line 4*a*—4*a* of FIG. 3.
Figure 4B:
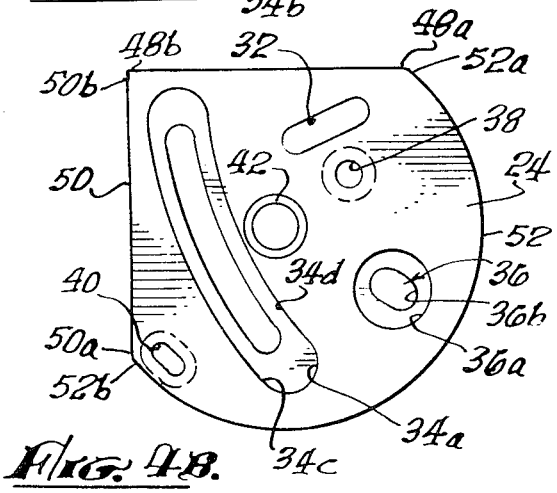
FIG. 4*b* is a cross-sectional view taken along line 4*b*—4*b* of FIG. 3.

The hinge body 24 is best illustrated in FIGS. 2, 4*a*, and 4*b*. It has three edges, 48, 50, and 52, the one 52 being arcuately shaped, the other two 48 and 50 being straight. These edges abut each other at their ends such that the end 48*a* of the straight edge 48 abuts the end 52*a* of the arcuate edge, the straight edge 50 at its end 50*a* abuts the end 52*b* of the arcuate edge, and the two straight edges abut each other at their respective ends 48*b* and 50*b* to form there between an angle of approximately 90°. The arcuately shaped edge encompsses a segment of a circle which is slightly greater than one-half a circle. Thus, approximately one-half of the surface of the body is enclosed within a semi-circle and the other surface of the body is enclosed within a triangle.

Two slots 32 and 34 in the hinge body provide tracks in which the pins 44 and 46 are guided during opening and closing of the cover 14. The slot 32 is of uniform dimensions as viewed from both the front and back of the hinge body and lies along a straight line. The width of this slot is just slightly greater than the diameter of the pin 44 so that the pin fits into the slot but does not touch the sidewalls defining the slot. These walls are generally straight and parallel to each other.

The slot 34 changes in dimensions as viewed from the front and back of the hinge body. This slot expands from a slot opening 34*b* in the face of the hinge body into the sunken track section 34*a* which has the same general shape as the slot opening, but is of larger dimensions. The width of the slot opening presented in the face of the hinge body is just slightly larger than the diameter of the pin. The width of the track section 34*a* are viewed from the back is slightly less than the width of the friction member 22. The sides of the track section are arcuate with respect to each other, the side 34*c* being concave and the side 34*d* being convex. The depth of the track section is about equal to or slightly greater than the thickness of the friction member 22.

The slot 36 receives the leveling member 26 and it expands from an elongated slot 36*b* into an enlarged circular indentation 36*a*. As will be discussed in detail below, this in combination with the leveling member 26 permits leveling of the cover 14.

Figure 9A:
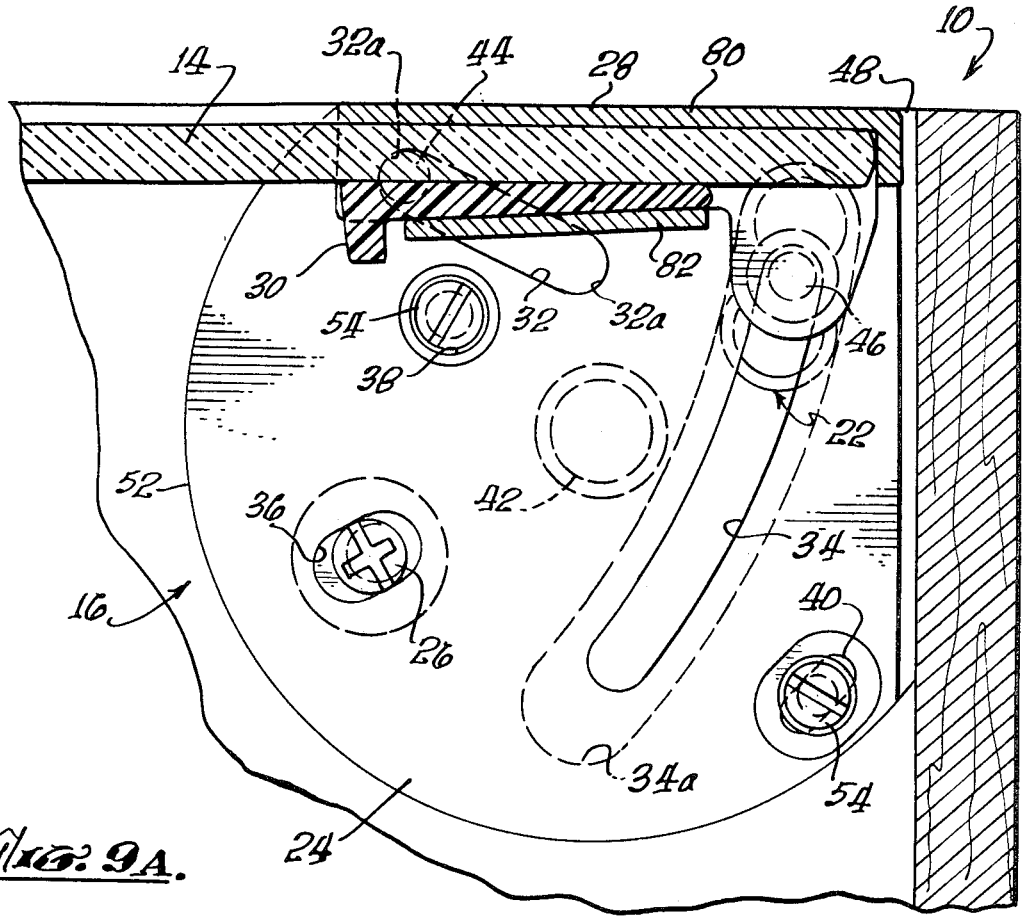
FIG. 9*a* is a side-elevational view, of the hinge partially in cross section, showing the glass cover in a down position.
Figure 9B:
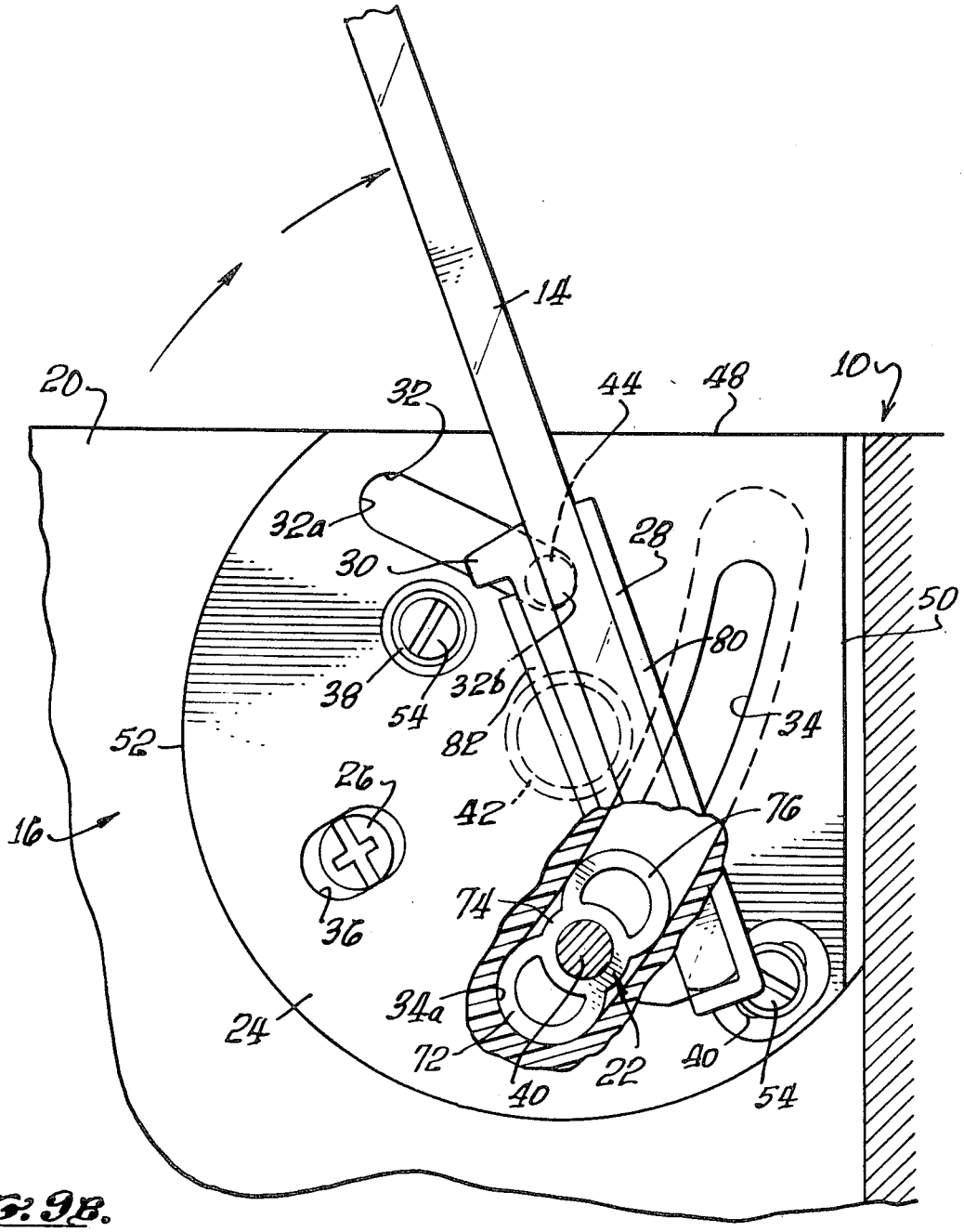
FIG. 9*b* is a side-elevational view of the hinge, with sections broken away, showing the glass cover in the fully raised position.

In addition to the slots 32, 34 and 36, the hinge body includes the screw openings 38 and 40. As viewed from the front side (FIG. 4*a*), each of these openings has a marginal cavity 38*a* and 40*a* disposed about it which receives therein the head of a screw 54 (FIGS. 9*a* and 9*b*). The depth of the cavity is sufficient to insure that the screw head will be flush with the face of the hinge body when the screw has been tightened down to secure the hinge body within the recess. The opening 40, and its cavity 40*a*, are elongated. As will be explained in detail below, this permits the hinge body 24 to be rotated during the leveling of the cover 14.

Figure 3:
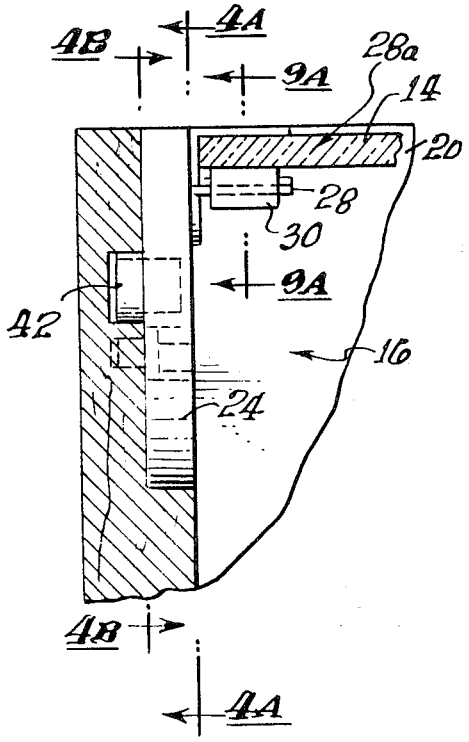
FIG. 3 is a cross-sectional view taken along line 3—3 of FIG. 1.
Figure 5A:
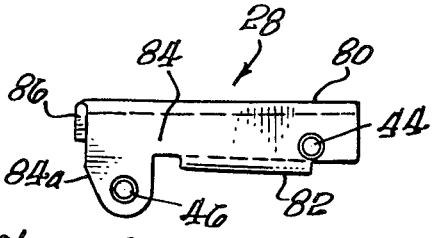
FIG. 5*a* is a side-elevational view of one side of the cover holder.
Figure 5C:
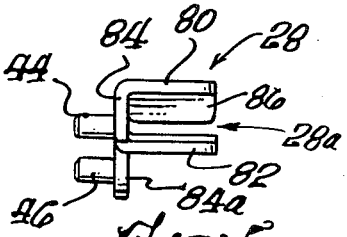
FIG. 5*c* is an end elevational view of the cover holder.
Figure 5B:
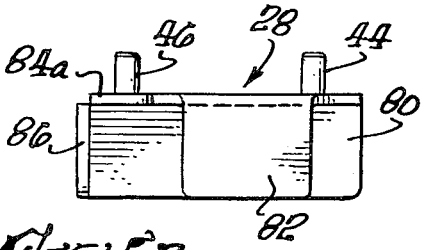
FIG. 5*b* is a bottom view of the cover holder.
Figure 5D:
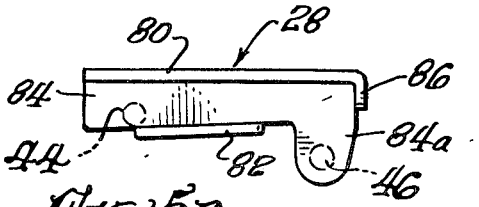
FIG. 5*d* is a side-elevational view of the other side of the cover holder.

As illustrated in FIG. 2, the hinge body 24, which has been especially designed for easy installation, is received within a recess 56 in an enclosure wall 58 at the corner of the enclosure 10. In the manufacture of the enclosure, the recess 56 may be formed in the wooden wall by means of a gang drill, which upon boring into the wood provides a recess having a configuration essentially identical in outline to that of the hinge body. Such a hinge body outline has been selected because it conforms to a recess configuration which is easy to form in the side of the wood wall using conventional gang drills. Note, the recess 56 has a depth equal to or slightly greater than the thickness of the hinge body, two open sides 56*a* and 56*b*, and a arcuately shaped rim 56*c* which abuts at its respective ends the ends of the open sides 56*a* and 56*b*. The open side 56*a* is in the exposed edge surface of the wall 58 and the open side 56*b* is in the concealed edge surface of the wall and is at the junction where the wall 58 meets the wall 60 to form the corner. These open sides have a length equal to the length of the straight edges 48 and 50 of the hinge body. Thus, when the hinge body is seated in the recess, the straight edge 48 is adjacent the open side 56*a* and flush with the top edge surface of the wall as shown in FIG. 3, the other straight edge 50 is adjacent the open side 56*b* and abuts, or at least is adjacent the face of the wall 60, and the arcuately shaped edge 52 is adjacent and immediately next to the rim 56*c*. In the floor 56*d* of the recess there is a pair of bores 62 and 64 and, the one 62 receives the pivot member 42 extending outwardly from the face of the hinge body and the other which receives the rod 66 extending from the leveling member 26. These bores are formed during the gang drilling operation. Two screw holes 68 and 70 are also formed during the gang drilling operation which receive the tapered ends of screws 54 that secure the hinge body within the recess 56.

Figure 6A:
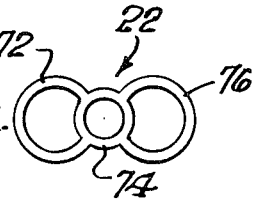
FIG. 6*a* is a side elevational view of the friction member.
Figure 6C:
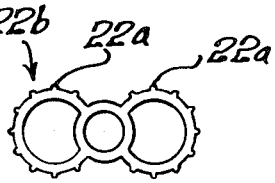
FIG. 6*c* is a side elevational view of an alternate embodiment of a friction member.
Figure 6B:
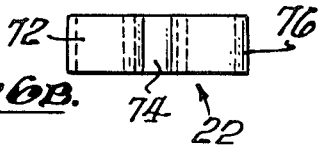
FIG. 6*b* is a plan view of the friction member.

As shown in FIGS. 6*a* and 6*b* the friction member is made of a resilient plastic material such as polyethylene and it includes three thin wall annuli 72, 74, and 76 joined together at their sides. The two outer annuli 72 and 76 have larger diameters than the center annulus 74, whose diameter is about equal to the diameter of the pin 46. This central annulus provides a socket for the pin. The diameter of the two outer annuli are slightly larger than the width of the sunken track section 34*a*. Since the friction member is made of a resilient material, the two end annuli 72 and 76 are deformed slightly when the friction member is inserted into the track section 34*a*. The resiliency of the plastic material causes the member to be biased against that part of the hinge body defining the sides of the track section. The friction force between the sides of the track section and the friction member is sufficient to hold the cover in a fully or partially raised position.

Figure 7A:
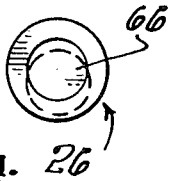
FIG. 7*a* is an elevational view from one end of the leveling member.
Figure 7B:
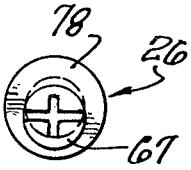
FIG. 7*b* is an elevational view of the leveling member viewed from the end opposite that shown in FIG. 7*a*.
Figure 7C:
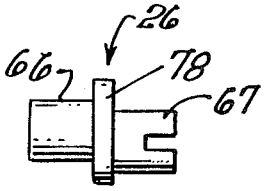
FIG. 7*c* is a side-elevational view of the leveling member.
Figure 8A:
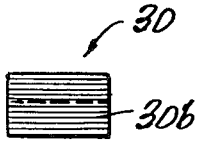
FIG. 8*a* is an end view of the wedge.
Figure 8B:
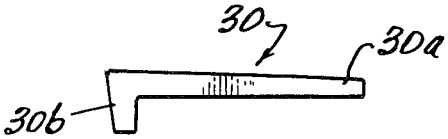
FIG. 8*b* is a side elevational view of the wedge.

As shown in FIGS. 7*a*, 7*b* and 7*c*, the leveling member 26 comprises a circular disc 78 having a pair of rods 66 and 67 extending outwardly from opposite sides of the disc. The rods 66 and 67 are displaced with respect to each other so that each rod lies along a different axis than the other rod and each of these axes are displaced with respect to the center of the disc. The rod 67 has cross-wise grooves in its one end and this end passes through the elongated slot 36 in the hinge body, with the disc 78 being received within the circular indentation 36*a* in the back of the hinge body. The circular indentation is larger in diameter than the disc. The other rod 66 is inserted in the bore 64 in the recess. By inserting a screwdriver or the like into the grooves and turning the leveling member, the disc rotates, pushing against the side walls of the circular indentation. If the hinge body has not been fastened securely by screws 54, this will cause the hinge body 24 to rotate, with the pivot member 42 serving as an axle. As will be explained in greater detail below, this enables an installer to level the glass cover 14.

The cover holder 28, as shown in FIGS. 5*a* through 5*d*, includes a pair of spaced-apart flat lips, a rear wall 84 having a foot element 84*a* extending downwardly therefrom, and a back wall 86 extending downwardly at a right angle from the top lip 80. The rear wall 84 is connected between the lips 80 and 82 to define the mouth 28*a* which receives the glass cover 14. The pins 44 and 46 extend outwardly from the rear wall, with the one pin 44 being in the main section of the rear wall and the other pin 46 being in the foot element 84*a*.

The installation of the hinge is simple. As mentioned above, the manufacture of the enclosure uses a gang drill to form the recess 56 and provide the bores 62 and 64 and holes 68 and 70. The rod 66 of the leveling member is inserted into the bore 64, the friction member 22 is inserted into the sunken track section 34*a* of the slot 34, and the hinge body 24 is then placed in the recess 56, with the pivot member 42 being inserted into the bore 62. The bores 62 and 64 are positioned so that the disc 78 will be received within the circular indentation 36*a* in the hinge body, and the edges 48 and 50 of the hinge body are aligned with the open sides 56*a* and 56*b* of the recess. With the hinge body so disposed in the recess, one screw 54 is inserted into the openings 40 in the hinge body of the hinge 16, but tightened only partially. The cover holder 28 is than attached to this body by inserting the pin 46 through the slot opening 34 into the socket provided by the annulus 74 and the pin 44 is inserted into the slot 32. The same procedure is then followed with respect to the other hinge 18. The glass cover 14 is then placed into the open mouths 28*a* of the two cover holders 28 and the wedges 30 are forced between the glass and the bottom lips 82 in the respective cover holders 28 of the hinges 16 and 18.

Figure 10:
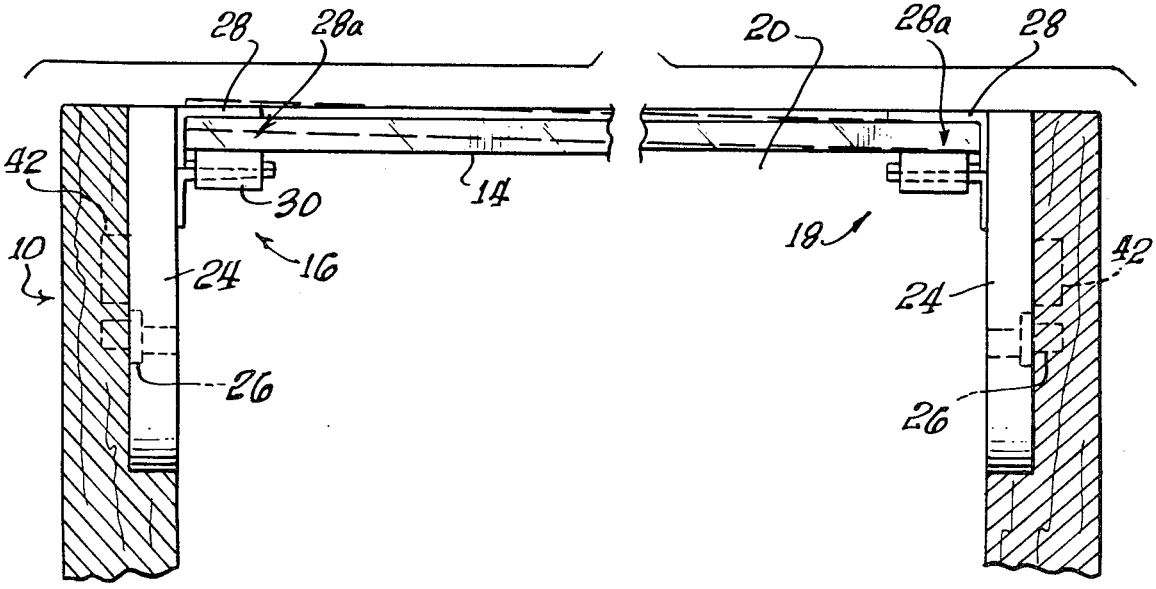
FIG. 10 is a front-elevational view of the enclosure showing the leveling of the glass cover.

As best shown in FIG. 10, if the cover is not level, (shown in dotted lines) one or both of the leveling members 26 are turned by inserting a screw driver into the grooved end of the rod 67 and turning. As the member 26 rotates, the disc 78 pushes against the wall defining the circular indentation 36*a*. This causes the hinge body 24 to pivot about the pivot member 42. Since the screw 54 in the elongated opening 40 has not been tightened, the hinge body will move with respect to this screw, with the length of the opening 40 limiting this movement of the hinge body. The leveling members are adjusted until the cover assumes the level position shown in solid lines. After leveling, the screw 54 is inserted into the opening 38 and both screws are tightened to secure the hinge body in a fixed position with the cover 14 level. If the glass cover is to be removed for cleaning or other purposes, the wedges 30 are simply retracted from the mouths 28*a* of the cover holders 28 by pressing a screwdriver or like instrument against the wedge's shoulder 30*b*. Placing the tip of the screwdriver between the shoulder and the edge of the bottom lip 82 and turning the screwdriver will provide sufficient force to pull out the wedge. The wedge, however, will stay in position indefinitely holding the glass cover secure unless so removed.

OPERATION

Figure 6D:
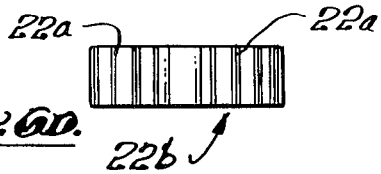
FIG. 6*d* is a plan view of the alternate embodiment of the friction member shown in FIG. 6*c*.

The person desiring access to the enclosure 10 grasps the free edge of the cover 14 and lifts the cover upwardly. This causes the pin 44 to ride in the slot 32 and the other pin 46 to pull the friction member 22 along the sunken track section 34*a*. When the pin 44 reaches the end 32*b* (FIG. 9*b*) of the slot 32, the cover cannot be raised any further. Conversely, when the pin 32 reaches the opposite end 32*a* (FIG. 9*a*) of the slot 32, the cover is closed and will not advance downwardly any further. As the cover 14 is moved between the closed and open positions, its pivot point continually changes, moving the rear edge of the cover away from the back wall 60 and downwardly into the enclosure as shown in FIG. 9*b*. The diameter of the end annuli are selected so that the friction forces are sufficient to hold the cover in any raised position at any point between the closed position and the fully raised position. For glass covers of differing weights, the diameter of the annuli will be increased or decreased as required. For example, as shown in FIGS. 6*c* and 6*d*, one simple and expedient way to increase the effective diameter of the annuli is to add one or more ribs 22*a* along the outer surface of the annuli. This could be easily accomplished during molding of the friction member 22*b*.

The above preferred embodiments may be modified, as mentioned above, and still embody the principles of this invention. For example, the pins need not be integral with the cover holder. They could be free members which ride within the slots and are received within holes of the cover member. It is preferred that the arcuate slot be closer to the back wall, however, in some instances the positions of the slots could be reversed. Moreover, two friction members could be employed, or the friction member could be in the slot 32 instead of the arcuate slot 34 as illustrated. These and other modifications may be made in the hinge of this invention and still come within the principles of this invention as defined by the appended claims.

What is claimed is:

1. A hinge for a cover for an opening in an enclosure, comprising:

a hinge body having first and second slots therein, and rotatably mounted to such enclosure;

a friction member disposed within the first slot and in frictional engagement with a portion of the hinge body defining the perimeter of said first slot;

means for holding the cover;

a pair of pin means coupling the cover holding means to the hinge body, one of said pin means being coupled to the friction member and the other being disposed within the second slot; and leveling means including an eccentric cam mounted to rotate the hinge body relative to the enclosure.

2. The hinge of claim 1 wherein the hinge body has three edges, one of said edges being arcuately shaped and the other two edges being generally straight, said edges abutting each other at their ends such that one of said straight edges abuts one end of the arcuately shaped edge, the other of said straight edges abuts the other end of the arcuately shaped edge and the two straight edges abut each other at the ends remote from the arcuately shaped edge to form an angle therebetween of approximately 90°.

3. The hinge of claim 2 wherein the arcuately shaped edge encompasses approximately a semi-circle.

4. The hinge of claim 2 wherein the hinge body is adapted to be secured within a recess in an enclosure wall near a corner of the enclosure where adjacent walls meet, said recess having a depth about equal to the thickness of the hinge body and two open sides having lengths approximately equal in length of the straight edges of the hinge body and an arcuately shaped rim abutting at its opposed ends the open sides, one of the open sides being in an exposed edge surface of one of the walls forming the corner and the other open side being in the non-exposed edge surface of said one wall and disposed along the corner, said hinge body being seated in the recess with one straight edge adjacent the open side of the recess disposed along the corner, the other straight edge adjacent the open side in the exposed edge surface of the wall and approximately flush with the exposed edge surface and the arcuately shaped edge adjacent the arcuate rim of the recess.

5. The hinge of claim 1 wherein the pin means are attached to the cover holding means.

6. The hinge of claim 5 wherein the cover holding means includes an open mouth which receives an edge of the cover and a first wall means opposite said mouth against which the cover rests when inserted into the mouth.

7. The hinge of claim 6 wherein the pin means extend outwardly from the wall means.

8. The hinge of claim 6 in which a pair of lip means are disposed on opposite sides of the mouth, with a second wall means extending from one of the lip means into the open mouth near one end of the mouth closest to a wall of the enclosure so that the cover rests against both the first and second wall means when inserted into the mouth.

9. The hinge of claim 8 including wedge means inserted into the mouth between the cover and one of the lips means to secure the cover in position.

10. The hinge of claim 9 wherein the wedge means includes shoulder means which enable a wedge removal device to be pushed against the shoulder means for removal of the wedge means from the mouth.

11. The hinge of claim 1 including leveling means for leveling the cover with respect to the enclosure opening.

12. The hinge of claim 1 wherein the first and second slots are disposed along lines which intersect with each other, with one of the slots having opposed elongated sides which are generally straight and parallel to each other and the other slot having opposed elongated sides which are arcuate, one being concave the other being convex.

13. The hinge of claim 1 wherein the friction member is made of a resilient material and is deformed slightly upon being inserted into the first slot, so that it is biased against at least a portion of the hinge body defining the sides of the slot.

14. The hinge of claim 1 wherein the friction member is in the form of a plurality of thin wall annuli joined together, with one of the annuli serving as a socket for the pin means and the other bearing against at least a portion of the hinge body defining the slot.

15. A hinge for a cover for an opening in an enclosure, comprising:

a hinge body having first and second slots therein, and adapted to be secured within a recess in such enclosure, and mounted for rotation while disposed within the recess prior to being secured;

a friction member disposed within the first slot and in frictional engagement with a portion of the hinge body defining the perimeter of the slot;

means for holding the cover;

a pair of pin means coupling the cover holding means to the hinge body, one of said pin means being coupled to the friction member and the other being disposed within the second slot; and leveling means having a member including an eccentric element thereon, said member being mounted for rotation with the eccentric element disposed within a third slot within the hinge body, and engaging the hinge body so that rotation of the member causes the hinge body to rotate.

16. A hinge for a cover for an opening in an enclosure, said hinge being adapted to be mounted within a recess in an enclosure wall and comprising:

a hinge body having first and second slots therein, and rotatably mounted to such enclosure within said recess;

a friction member disposed within the first slot and in frictional engagement with a portion of the hinge body defining the perimeter of the first slot, said friction member having a socket element therein and being resilient so that it is biased outwardly to bear against a portion of the hinge body, and means for holding the cover so that it may be secured in a fixed position but readily removed from the holding means, said cover holding means having an open mouth adapted to receive an edge of the cover, wall means opposite said mouth, and a pair of pin means extending from the outside surface of the wall means, one of said pin means being inserted into the socket element in the friction member and the other pin means being disposed within the second slot; and leveling means including an eccentric cam mounted to rotate the hinge body relative to the enclosure;

said hinge, upon manual actuation, moving between an open position with the cover raised and a closed position with the cover over the enclosure opening, said one pin means pulling the frictional member along the first slot and the other pin means riding in the second slot as the hinge moves between said positions.

17. The hinge of claim 16 wherein the first slot includes a sunken track section which has the same general shape as said first slot but is larger and the friction member rides within said track section.

18. The hinge of claim 16 wherein the hinge body has three edges, one of said edges being arcuately shaped and the other two edges being generally straight, said edges abutting each other at their ends such that one of said straight edges abuts one end of the arcuately shaped edge, the other of said straight edges abuts the other end of the arcuately shaped edge and the two straight edges abut each other at the ends remote from the arcuately shaped edge to form an angle therebetween of approximately 90°.

19. The hinge of claim 18 wherein the arcuately shaped edge encompasses approximately a semi-circle.

20. The hinge of claim 16 in which a pair of lip means are disposed on opposite sides of the mouth, with a second wall means extending from one of the lip means into the open mouth near one end thereof closest to a wall of the enclosure so that the cover rests against both the first and second wall means when inserted into the mouth.

21. The hinge of claim 20 including wedge means inserted into the mouth between the cover and one of the lip means to secure the cover in position.

22. The hinge of claim 21 wherein the wedge means includes shoulder means which enable a wedge removal device to be pushed against the shoulder means for removal of the wedge means from the mouth.

23. The hinge of claim 16 including leveling means for leveling the cover with respect to the enclosure opening.

24. The hinge of claim 16 wherein the first and second slots are disposed along lines which intersect each other, with one of the slots having opposed elongated sides which are generally straight and parallel to each other and the other slot having opposed elongated sides which are arcuate, one being concave the other being convex, and which converge slightly toward one end of the slot.

25. A hinge for a cover for an opening in an enclosure, comprising:

a hinge body having first and second slots therein, and adapted to be secured within a recess in such enclosure, and mounted for rotation within the recess prior to being secured;

a friction member disposed within the first slot and in frictional engagement with a portion of the hinge body defining the perimeter of the first slot, said friction member having a socket element therein and being resilient so that it is biased outwardly to bear against a portion of the hinge body;

means for holding the cover so that it may be secured in a fixed position but readily removed from the holding means, said cover holding means having an open mouth adapted to receive an edge of the cover, wall means opposite said mouth, and a pair of pin means extending from the outside surface of the wall means, one of said pin means being inserted into the socket element in the friction member and the other pin means being disposed within the second slot; and leveling means, for leveling the cover with respect to the enclosure opening, having a member including an eccentric element thereon, said member being mounted for rotation with the eccentric element disposed within a third slot in the hinge body and engaging the hinge body, so that rotation of the member causes the hinge body to rotate;

said hinge, upon manual actuation, moving between an open position with the cover raised and a closed position with the cover over the enclosure opening, said one pin means pulling the frictional member along the first slot and the other pin means riding in the second slot as the hinge moves between said positions.

* * * * *